US011335997B2

(12) United States Patent
Mayer et al.

(10) Patent No.: US 11,335,997 B2
(45) Date of Patent: May 17, 2022

(54) CONDUCTIVELY COATED WINDOW PANE FOR RAIL VEHICLES

(71) Applicant: SIEMENS AG OESTERREICH, Vienna (AT)

(72) Inventors: Lukas Walter Mayer, Vienna (AT); Andreas Demmer, Vienna (AT); Mehrdad Madjdi, Vienna (AT); Andreas Hofmann, Vienna (AT); Martin Schiefer, St. Pölten (AT)

(73) Assignee: SIEMENS MOBILITY AUSTRIA GMBH, Vienna (AT)

( * ) Notice: Subject to any disclaimer, the term of this patent is extended or adjusted under 35 U.S.C. 154(b) by 431 days.

(21) Appl. No.: 15/768,194

(22) PCT Filed: Oct. 11, 2016

(86) PCT No.: PCT/EP2016/074327
§ 371 (c)(1),
(2) Date: Apr. 13, 2018

(87) PCT Pub. No.: WO2017/064054
PCT Pub. Date: Apr. 20, 2017

(65) Prior Publication Data

US 2018/0309196 A1 Oct. 25, 2018

(30) Foreign Application Priority Data

Oct. 16, 2015 (AT) ..... A50879/2015

(51) Int. Cl.
*H01Q 1/32* (2006.01)
*H01Q 1/12* (2006.01)
(Continued)

(52) U.S. Cl.
CPC ..... *H01Q 1/3283* (2013.01); *H01Q 1/1271* (2013.01); *H01Q 1/2291* (2013.01);
(Continued)

(58) Field of Classification Search
CPC ..... H01Q 15/0013
See application file for complete search history.

(56) References Cited

U.S. PATENT DOCUMENTS 5,945,957 A 8/1999 Kakizawa
6,400,334 B1 6/2002 Lindenmeier et al.
(Continued)

FOREIGN PATENT DOCUMENTS

CN 1289156 3/2001
CN 101345333 1/2009
(Continued)

OTHER PUBLICATIONS

Rong-Rong Xu et al., "Dual-Band Capacitive Loaded Frequency Selective Surfaces with Close Band Spacing", IEEE Microwave and Wireless Components Letters, IEEE Service Center, New York, NY Bd. 18, Nr. 12, pp. 782-784, 2008.
(Continued)

*Primary Examiner* — Ian A Rummel
(74) *Attorney, Agent, or Firm* — Cozen O'Connor

(57) ABSTRACT

A coated window pane for rail vehicles, wherein the coating is made in a structured and electrically conductive form and includes filtering characteristics for radio signals, where the coating is structured as a conductive periodic grating, in which at least two annular coatings are respectively embedded in the intermediate spaces, the at least two annular coatings are respectively filled by a coated area, and the grating, the annular coatings and the coated areas are separated by insulating regions such that the coated, structured window panes have filtering characteristics such that signals or frequency ranges of signals from and to radio communication systems are arranged outside the vehicle pass through and signals or frequency ranges of signals from and to radio communication devices arranged inside the vehicle are blocked or are greatly attenuated, and such that high require-
(Continued)

ments with respect to heat shielding and sun shielding properties are also met.

13 Claims, 1 Drawing Sheet

(51) Int. Cl.
*H01Q 1/22* (2006.01)
*H01Q 1/24* (2006.01)
*H01Q 15/00* (2006.01)

(52) U.S. Cl.
CPC ..... *H01Q 1/241* (2013.01); *H01Q 1/32* (2013.01); *H01Q 15/0013* (2013.01)

(56) References Cited

U.S. PATENT DOCUMENTS

| | | | | |
|---|---|---|---|---|
| 2014/0065330 | A1 | 3/2014 | Calomfirescu et al. | |
| 2015/0343884 | A1* | 12/2015 | Rousselet ..... | B32B 7/12 359/360 |

FOREIGN PATENT DOCUMENTS

| | | |
|---|---|---|
| CN | 101345334 | 1/2009 |
| CN | 101868738 | 10/2010 |
| CN | 102714344 | 10/2012 |
| CN | 103502078 | 1/2014 |
| EP | 0854534 | 7/1998 |
| JP | 2005-012587 | 1/2005 |
| WO | WO/2014/060203 | 4/2014 |
| WO | WO 2014/135296 | 9/2014 |
| WO | WO 2014/166869 | 10/2014 |

OTHER PUBLICATIONS

Irfan Ullah et al., "Transmission improvement of UMTS and Wi-Fi signals through energy saving glass using FSS", Wireless and Microwave Technology Conference (WAMICON), IEEE 12$^{th}$ Annual, IEEE, pp. 1-5, 2011.

Office Action dated Sep. 23, 2020 issued in Chinese Patent Application No. 201680060495.4.

* cited by examiner

CONDUCTIVELY COATED WINDOW PANE FOR RAIL VEHICLES

CROSS-REFERENCE TO RELATED APPLICATIONS

This is a U.S. national stage of application No. PCT/EP2016/074327 filed Oct. 11, 2016. Priority is claimed on Austria Application No. A50879/2015 filed Oct. 16, 2015, the content of which is incorporated herein by reference in its entirety.

BACKGROUND OF THE INVENTION

1. Field of the Invention

The present invention relates to a coated window pane, in particular for rail vehicles, where the coating is made in a structured and electrically conductive form and has filtering characteristics for radio signals.

2. Description of the Related Art

In vehicles, such as rail vehicles for passenger transport, availability of current communication services, such as mobile voice communications, or mobile data communications, based on, for example, Global System for Mobile Communications (GSM), Universal Mobile Telecommunications System (UMTS) and Long-Term Evolution (LTE), is increasingly being demanded. Therefore, an optimum reception level and a corresponding reception quality are also demanded in vehicles, particularly public transport, such as trains, or trams.

One obstacle to good reception are conductively coated window panes in these vehicles. The coating is used for heat and sun shielding. However, it is not merely heat radiation or the sun's rays that are reflected by the coating of the window panes, but also other electromagnetic waves, such as electromagnetic waves for mobile communication services of radio communication equipment.

The vehicle therefore has a high transmission loss for electromagnetic waves and acts like a Faraday cage. For example, the attenuation is approximately 30 dB in the case of the Intercity Express or ICE. Shielding is therefore about 99.9%.

Instead of dispensing with or reducing the coating, and therefore removing or reducing the heat and sun protection, what are referred to as in-train repeaters are known from the prior art, such as from the website Wikipedia, are used to overcome the transmission loss. In-train repeaters are intended to improve communication between a mobile terminal (such as a mobile phone, a tablet PC, or Smartphone) and radio communication equipment, which is located outside the vehicle (for example, a mobile network), and enable an optimally interference-free communication link.

Without an in-train repeater, interference-free use of mobile communications services or an interference-free connection without dropouts would be possible only in those areas that have a sufficiently high field strength to overcome the shielding of vehicles such as modern passenger trains. This is conventionally the case in urban areas and in railway stations. Especially in rural areas, radio communication equipment, such as mobile networks based on Global System for Mobile Communications (GSM) or Universal Mobile Telecommunications System (UMTS) standards, are not as strongly or densely developed. Consequently, a supply or corresponding connection to the radio communication equipment of vehicles or individual cars is not always guaranteed without in-train repeaters.

DE 195 03 892 C1 and document EP 2 586 610 A1 discloses exemplary window panes for use in vehicles (for example, motor vehicles), through which the reception level for mobile terminals (for example, mobile phones) in the interior of a vehicle is increased, even without the use of a repeater. These window panes are provided with an electrically conductive, transparent layer. The conductive layer is applied and structured, for example, via vapor deposition onto the pane. Structuring of the layer is formed such that radio signals, in particular frequency ranges, can pass optimally unhindered.

To be able to provide communication services, in particular mobile data services, in vehicles such as the Deutsche Bahn ICE or the Austrian Federal Railways Railjet, etc., wireless internet access is currently available, for example, in these vehicles. For this purpose, for example, the vehicle or the train is fitted with Wireless Local Area Network (WLAN) technology (WLAN hotspots, which are connected to the Internet via a server and the land mobile radio stations), such that the mobile data services or wireless Internet is available in all cars of the train. However, signals from radio communication equipment that is outside the vehicle and use the same frequency range, can disrupt the communication quality of the WLAN connection inside the vehicle. Furthermore, communications services offered for example, in a vehicle which, for example, are offered, to passengers for free, could also be used from outside the vehicle. In addition, radio communication equipment outside the vehicle can also be disrupted by the radio signals of the radio communication systems provided in the vehicle.

WO 2014/166869 discloses a coated window pane in which the coating is formed so as to be frequency selective. The coating has a filtering characteristic such that signals or frequency ranges of signals from and to radio communication systems, which are arranged outside the vehicle, are allowed to pass through, and that signals or frequency ranges of signals from and to radio communication equipment, which is arranged inside the vehicle, are blocked or greatly attenuated.

For this purpose, the coating has a structuring with structural elements.

SUMMARY OF THE INVENTION

In view of the foregoing, it is an object of the invention to provide a coated window pane, in particular for rail vehicles, where the coating is made in a structured and electrically conductive form and has filtering characteristics for radio signals.

This and other objects and advantages are achieved in accordance with the invention by a coated window pane, where the coating is structured as a conductive periodic grating (RG, HG), in which at least two annular coatings (R) are respectively embedded in the intermediate spaces, where the at least two annular coatings (R) are respectively filled by a coated area (F), and where the conductive periodic grating (RG, HG), the annular coatings (R) and the coated areas (F) are separated by insulating regions (I).

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is illustrated in more detail with reference to two figures, by way of example and schematically, in which.

DETAILED DESCRIPTION OF THE EXEMPLARY EMBODIMENTS

Figure 1:
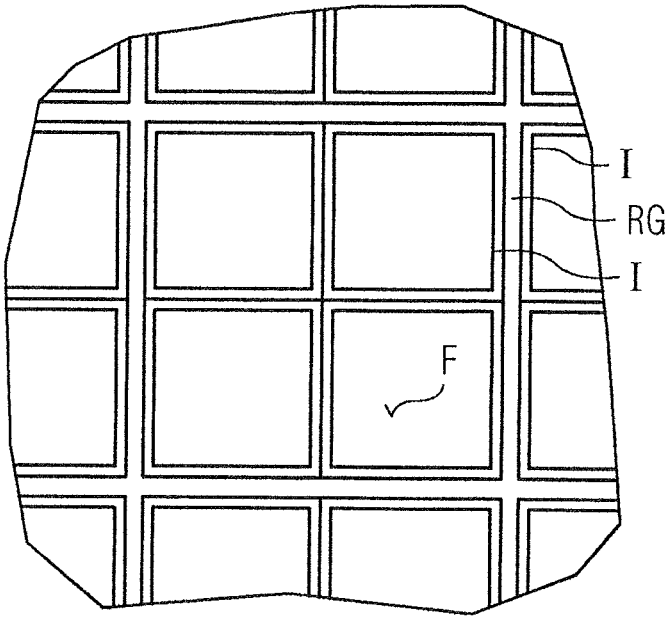
FIG. 1 shows the structure of the coating of a window pane based on a rectangular grating; in accordance with the invention.

FIG. 1 shows schematically and exemplarily a section of an inventive conductively coated window pane, which can advantageously be used in vehicles, such as rail vehicles, but also in windows of fixed objects. The window pane has an electrically conductive and largely transparent coating, which is frequency selective because of its inventive structuring, i.e., it has a high permeability for radio signals of a particular frequency band and attenuates radio signals with a different frequency.

The coating is made, for example, with metals or metal oxides, but other materials are also conceivable.

By suitable, configuration of the structuring of the coating, the window pane allows, on the one hand, signals from and to radio communication equipment, such as mobile networks to the Global System for Mobile Communications (GSM), the Universal Mobile Telecommunications System (UMTS) or the Long-Term Evolution (LTE) standards or possibly also signals from Global System for Mobile Communications-Railway (GSM-R) networks, Digital Video Broadcasting-Terrestrial (DVB-T), Very High Frequency (VHF) radio waves or BOS radio systems, such as Terrestrial Trunked Radio (TETRA), to pass through. On the other hand, signals from and to radio communication equipment, such as wireless LAN, are blocked.

In accordance with the invention, the coating has the structure of a conductive periodic grating RG, HG, in the intermediate spaces of which at least two annular coatings R are respectively embedded, and where the at least two annular coatings R are respectively filled by a coated area F and the grating RG, HG, the annular coatings R and the coated areas F are separated by insulating regions.

In the exemplary embodiment of FIG. 1, the periodic grating is constructed as a rectangular grating RG. Each rectangle has a square shape and includes four likewise square annular coatings R, each of which encloses a square area F.

It should be noted that the term ring, or annular coating R, includes not only circular shapes but also a closed polygon that encloses a square in the specific exemplary embodiment, but in other possible embodiments can also have, for example, the shape of a triangle, hexagon or a diamond.

Furthermore, a ring can have different widths, in other words, it is then defined by an inner and outer closed polygon, which can have different shapes. For example, the inner polygon of a ring could be square. The outer polygon could, by contrast, be hexagonal, etc.

The rectangular grating RG, the annular coatings R in the form of a closed square polygon and the coated areas F are separated by insulating regions I. In the figures, the insulating regions I are represented by the black lines, while the light regions represent the coatings.

Structures are also conceivable in which yet more rings are embedded within the first rings R. The respective innermost ring is then filled by a coated, such as metallized area F.

Figure 2:
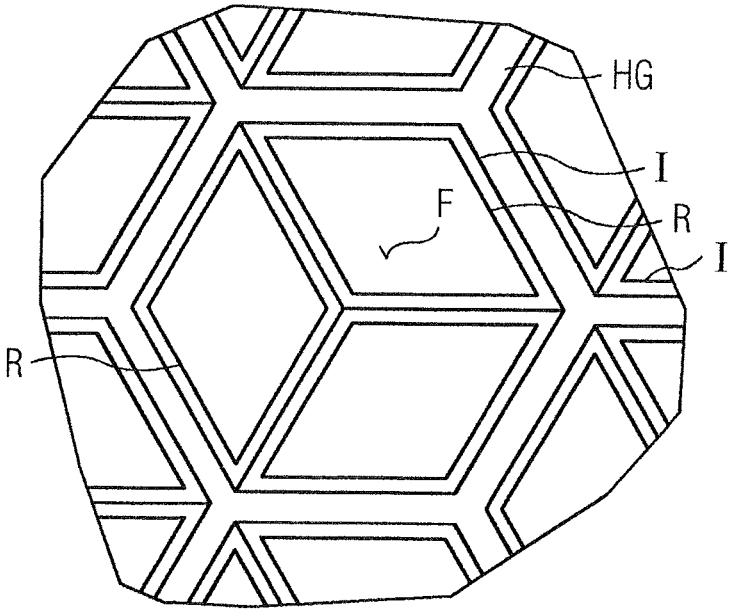
FIG. 2 shows the structure of the coating of a window pane based on a hexagonal grating in accordance with the invention.

FIG. 2 shows an exemplary embodiment, where the periodic grating is constructed as a hexagonal grating HG. In the present exemplary embodiment, each hexagon comprises three diamond-shaped polygons as rings R, each of which encloses a, for example, diamond-shaped, coated, such as metallized, area F.

The geometry of a structure for a particular application with predefined radio properties of the coated window pane, generally a frequency transmission characteristic, can be determined by way of field simulation with knowledge of the pane construction used, the data of the coating, generally a surface resistance and line widths, which are visually still acceptable and are feasible in terms of engineering technology.

Typical output data is for example:

- The frequency characteristic: transmission range, for example, between 700 MHz and 2.7 GHz (for LTE, GSM, and UMTS frequencies) with attenuation less than 10 dB. Stopband, for example, between 5.2 and 5.8 GHz (for WLAN/WiFi) with attenuation greater than 20 dB.
- The angle dependency: The required frequency characteristic is retained for an incident angle range from −45° to +45° over all spatial directions.
- The pane construction: glass thickness of the inner and outer panes between 3 mm and 10 mm with a relative dielectric constant of 4 to 8. The panes can be single-layer (SL) or multiple layer (ML) and contain layers of plastics material (for example, sheets of PVB). Plastics material can be used instead of glass, whereby the dielectric constant is typically lowered. The gap size between the glass elements is typically 8 to 20 mm. The panes can be curved or flat.
- Structuring: Structuring of the coating with gaps smaller than about 0.5 mm is typical and reduces the visual perceptibility.

The structure of the coating in accordance with the invention allows optimal transmission properties at low frequencies and a stopband at high frequencies.

The more annular elements R are inserted inside the grating intermediate spaces, the smaller these elements are and the higher the blocking frequency. The ratio of the high blocking frequency and the low lowest transmission frequency can be chosen, for example, at approx. 8. Consequently, a passband above 700 MHz and a stopband at 5.5 GHz can be achieved. Relative 3 dB bandwidths of the transmission range of over 100% can be achieved.

Therefore, the number and configuration of the annular elements R inside the grating intermediate spaces is of particular importance for the design of the filtering characteristics. The annular elements R offer the possibility to adapt the filtering characteristics of the window panes in a particularly advantageous manner to very different conditions.

To allow the lowest transmission frequency to still pass, the grating RG, HG must be made so large that the mesh size is about one quarter of the wavelength. Here, it is not the free wavelength that is used, but the effective wavelength, which is reduced by the influence of the glass elements.

The surface elements F inside the rings R are selected in terms of their size such that, at the blocking frequency, they self-resonate, in other words are about half the effective wavelength.

Different sizes and shapes of surface elements F, which are in the grating intermediate space, can be chosen to achieve fine forming of the blocking characteristics.

The rings (polygons) R fulfill the purpose of reducing the reciprocal influencing of gratings RG, HG and surface elements F. The Rings R reduce the attenuation in the transmission range that upwardly adjoins the minimum transmission frequency. The high relative bandwidths in the transmission range are possible only due to the rings R.

The coating of the window panes can also be provided with a fine structure, by which the properties in the visual and thermal sphere are changed. For example, the appearance of the window panes can also be appropriately configured via the fine structure. For example, appealing structure patterns, shapes, lettering, or logos, can be implemented.

In a vehicle, the coated window panes can be arranged distributed over the sides of the vehicle. In this way, the reception conditions for radio communication equipment arranged outside the vehicle, as well as for radio communication equipment arranged inside the vehicle, are purposely configured in the context of the attained frequency-selective transmission characteristic.

Similarly, the window panes in accordance with the invention can also be used in other vehicles such as buses, and in buildings having coated windows.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those structures and/or elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A conductively coated window pane, the coating being made in a structured and electrically conductive form, and including filtering characteristics for radio signals, wherein the coating is structured as a conductive periodic grating, comprising:

at least two annular coatings respectively embedded in intermediate spaces of the coating, the at least two annular coatings being respectively filled by a respective coated area; and insulating regions which separate each respective conductive periodic grating and which completely surround each respective coated area within the conductively coated window pane, the annular coatings and the coated areas being separated by said insulating regions.

2. The conductively coated window pane as claimed in claim 1, wherein the coating comprises a metallization.

3. The conductively coated window pane as claimed in claim 1, wherein the conductive periodic grating is shaped as a rectangular grating.

4. The conductively coated window pane as claimed in claim 2, wherein the conductive periodic grating is shaped as a rectangular grating.

5. The conductively coated window pane as claimed in claim 1, wherein the conductive periodic grating is shaped as a hexagonal grating.

6. The conductively coated window pane as claimed in claim 2, wherein the conductive periodic grating is shaped as a hexagonal grating.

7. The conductively coated window pane as claimed in claim 1, wherein the coating is also provided with a structure via which visual and thermal properties are changed.

8. The conductively coated window pane as claimed in claim 1, further comprising:

radio communication equipment comprising a Wireless Local Area Network (WLAN) arranged in an interior of the vehicle.

9. The conductively coated window pane as claimed in claim 1, wherein signals from radio communication equipment conforming to at least one of Global System for Mobile Communications (GSM), Universal Mobile Telecommunications System (UMTS) and Long-Term Evolution (LTE) mobile radio standards comprise signals which are allowed to pass through the conductively coated window pane.

10. The conductively coated window pane as claimed in claim 1, wherein a plurality of the conductively coated window pane are arranged in a distributed manner over both longitudinal sides of a vehicle.

11. The conductively coated window pane as claimed in claim 10, wherein the vehicle comprises a rail vehicle.

12. The conductively coated window pane as claimed in claim 10, wherein the rail vehicle comprises one of a train and tram.

13. The conductively coated window pane as claimed in claim 1, wherein the coated window pane is installed in a rail vehicle.

* * * * *